US010811168B1

(12) United States Patent
Yagi

(10) Patent No.: US 10,811,168 B1
(45) Date of Patent: Oct. 20, 2020

(54) BRAIDED SHIELD AND SHIELDED ELECTRICAL WIRE

(71) Applicant: Yazaki Corporation, Tokyo (JP)

(72) Inventor: Daisuke Yagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/874,681

(22) Filed: May 15, 2020

(30) Foreign Application Priority Data

May 17, 2019 (JP) ..... 2019-093415

(51) Int. Cl.
*H01B 7/18* (2006.01)
*H01B 7/22* (2006.01)

(52) U.S. Cl.
CPC ..... *H01B 7/183* (2013.01); *H01B 7/228* (2013.01)

(58) Field of Classification Search
CPC ..... H01B 7/183; H01B 7/228
USPC ..... 174/108
See application file for complete search history.

(56) References Cited

U.S. PATENT DOCUMENTS 1,948,616 A * 2/1934 Fischer ..... H01B 11/00 174/103
3,090,825 A * 5/1963 Volk ..... H01B 9/023 174/109
3,505,144 A * 4/1970 Kilduff ..... H01B 13/00 156/259
4,157,518 A * 6/1979 McCarthy ..... C12C 3/08 174/108
4,268,714 A * 5/1981 Mori ..... B32B 15/04 174/108
4,599,121 A * 7/1986 Edwards ..... H01B 7/285 156/48
4,641,110 A * 2/1987 Smith ..... H01B 11/10 174/36
4,746,767 A * 5/1988 Gruhn ..... H01B 11/1016 174/36
5,023,405 A * 6/1991 Kwast ..... H01B 7/183 174/106 R
5,414,211 A * 5/1995 Chan ..... H01B 7/2806 156/51
6,384,337 B1 * 5/2002 Drum ..... H01B 11/1813 174/102 R (Continued)

FOREIGN PATENT DOCUMENTS

JP 2003-151380 A 5/2003
JP 2004-214138 A 7/2004
JP 2009-266592 A 11/2009

*Primary Examiner* — Timothy J Thompson
*Assistant Examiner* — Michael F McAllister
(74) *Attorney, Agent, or Firm* — Kenealy Vaidya LLP

(57) ABSTRACT

A braided shield includes at least one electrical wire; and a plurality of shield members that covers an outer circumferential surface of the electrical wire and is formed by interweaving into a cylindrical shape. The shield members each include a strip-shaped non-conductor film and a strip-shaped conductor member that is shorter than a width of the non-conductor film in a width direction. In a planar view of the shield member, the conductor member is stacked on the non-conductor film along the longitudinal direction thereof such that the non-conductor area and the conductor area are formed separately along the width direction of the non-conductor film.

16 Claims, 6 Drawing Sheets

(56) References Cited

U.S. PATENT DOCUMENTS

| | | | | |
|---|---|---|---|---|
| 6,843,660 | B2 * | 1/2005 | Barr | H01B 7/0009 439/67 |
| 2004/0055772 | A1 * | 3/2004 | Tsutsui | H01B 11/1016 174/36 |
| 2010/0108350 | A1 * | 5/2010 | Cases | H01B 13/26 174/102 R |
| 2010/0236810 | A1 * | 9/2010 | Mukai | H01B 11/206 174/105 R |
| 2011/0247856 | A1 * | 10/2011 | Matsuda | H01B 11/203 174/108 |
| 2014/0202756 | A1 * | 7/2014 | Adachi | H01R 13/6585 174/377 |
| 2016/0155540 | A1 * | 6/2016 | Matsuda | H01B 11/183 174/107 |
| 2016/0174422 | A1 * | 6/2016 | Kobayashi | H01B 11/002 174/107 |

* cited by examiner

BRAIDED SHIELD AND SHIELDED ELECTRICAL WIRE

CROSS-REFERENCE TO RELATED APPLICATION(S)

The present application claims priority to and incorporates by reference the entire contents of Japanese Patent Application No. 2019-093415 filed in Japan on May 17, 2019.

BACKGROUND OF THE INVENTION

1. Field of the Invention

The present invention relates to a braided shield and a shielded electrical wire.

2. Description of the Related Art

In vehicles such as automobiles, shielded electrical wires are used, for the sake of ease of handling and so forth, for communication cables and high-tension cables for which noise must be considered. Although a braided shield obtained by braiding a plurality of wire filaments in a cylindrical braided pattern (shield structure), for example, is used for a shielded electrical wire, the shield characteristics of the shielded electrical wire vary according to changes in the braided pattern. For example, when the shield coverage (braiding ratio) is raised by increasing the number of wire filaments in the braided shield or reducing the gaps between filament bundles, the shield characteristics tend to improve. On the other hand, if the braiding ratio rises to exceed a fixed value, the shield characteristics are conversely degraded. Furthermore, because raising the braiding ratio increases the number of wire filaments and may lead to an increase in the costs and weight of the shielded electrical wire, raising the braiding ratio is not necessarily considered to be effective.

Japanese Patent Application Laid-open No. 2003-151380 discloses a braided shield obtained by braiding using copper-clad aluminum wire filaments that have a cross-sectional structure obtained by placing a copper coating around an aluminum core. Japanese Patent Application Laid-open No. 2004-214138 discloses a coaxial cable obtained by stacking, on an insulating layer stacked on an internal conductor, three or four external conductor layers comprising metal braiding formed from tin-plated soft copper. Japanese Patent Application Laid-open No. 2009-266592 discloses a high-frequency coaxial cable having an external conductor in which copper PET tape is provided on the outer periphery of an insulating layer, and the outer peripheral side of the external conductor is retained by a press-winding layer formed of resin fibers.

Incidentally, when a shielded electrical wire has a braided pattern with optimal shield characteristics, because the braiding ratio is not 100%, there are a large number of gaps between filament bundles and there is a risk of degradation of the shield characteristics as a result of the braiding being disrupted by skewed overlapping between arrangements of filament bundles. When the braiding ratio is set high to account for braiding disruption, braiding a braided pattern with superior shield characteristics is not possible. Furthermore, if the wire filament diameter is made small and the number of wire filaments increases, as is the case for high-voltage lines, there is a risk of degradation of the shield characteristics due to braiding disruption.

SUMMARY OF THE INVENTION

The purpose of the present invention is to provide a braided shield and a shielded electrical wire that enable suppression of degradation of the shield characteristics and enable a lightweight construction by reducing the amount of conductor used in the braiding.

A braided shield according to one aspect of the present invention includes at least one electrical wire; and a plurality of shield members that covers an outer circumferential surface of the electrical wire and is formed by interweaving into a cylindrical shape, wherein the shield members each include a strip-shaped non-conductor film, and a strip-shaped conductor member having a width, in a width direction orthogonal to a longitudinal direction of the non-conductor film, that is shorter than a width of the non-conductor film in the width direction, and in a planar view of the shield member, the conductor member is stacked on the non-conductor film along the longitudinal direction thereof such that a non-conductor area and a conductor area are formed separately along the width direction of the non-conductor film.

According to another aspect of the present invention, in the braided shield, it is preferable that the conductor member forms, spaced apart along the width direction, a plurality of the conductor area.

According to still another aspect of the present invention, in the braided shield, it is preferable that when the width of the non-conductor film is A, a number of spindles of the braided shield is m, and an inner diameter of the braided shield is d, the following formula is satisfied:

$$A=d\times\pi/m.$$

According to still another aspect of the present invention, in the braided shield, it is preferable that when the width of the non-conductor film is A and a width of the conductor member is B, the following formula is satisfied:

$$A:B=10:5.$$

According to still another aspect of the present invention, in the braided shield, it is preferable that in a braided state obtained by interweaving the plurality of the shield members into a cylindrical shape, the plurality of the shield members are arranged side-by-side along a first direction and a second direction that intersects the first direction, the plurality of shield members form the braided area in which first two shield members that are a first shield member disposed along the first direction and a shield member adjacent to the first shield member, and second two shield members that are a second shield member disposed along the second direction and a shield member adjacent to the second shield member are overlapped, and in the braided area, the percentage of the non-conductor area is 25% of the braided area.

A shielded electrical wire according to still another aspect of the present invention includes the braided shield; and at least one electrical wire that is inserted into the braided shield.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a braided shield and a shielded electrical wire according to the present invention will be described in detail hereinbelow with reference to the accompanying drawings. Note that the present invention is not limited to or by the following embodiment. The constituent elements of the following embodiment include constituent elements that could easily be conceived by a person skilled in the art or which are substantially the same. Moreover, various omissions, substitutions and modifications can be made to the constituent elements of the following embodiment without departing from the spirit of the invention.

Embodiment

A braided shield and a shielded electrical wire according to an embodiment of the present invention will be described with reference to FIGS. 1 to 5. A shielded electrical wire 1 according to the embodiment is installed in a vehicle (not illustrated) such as an automobile and electrically connects constituent elements of the vehicle, for example. The shielded electrical wire 1 is preferably flexible. The shielded electrical wire 1 is configured comprising an electrical wire W and a braided shield 2.

Figure 1:
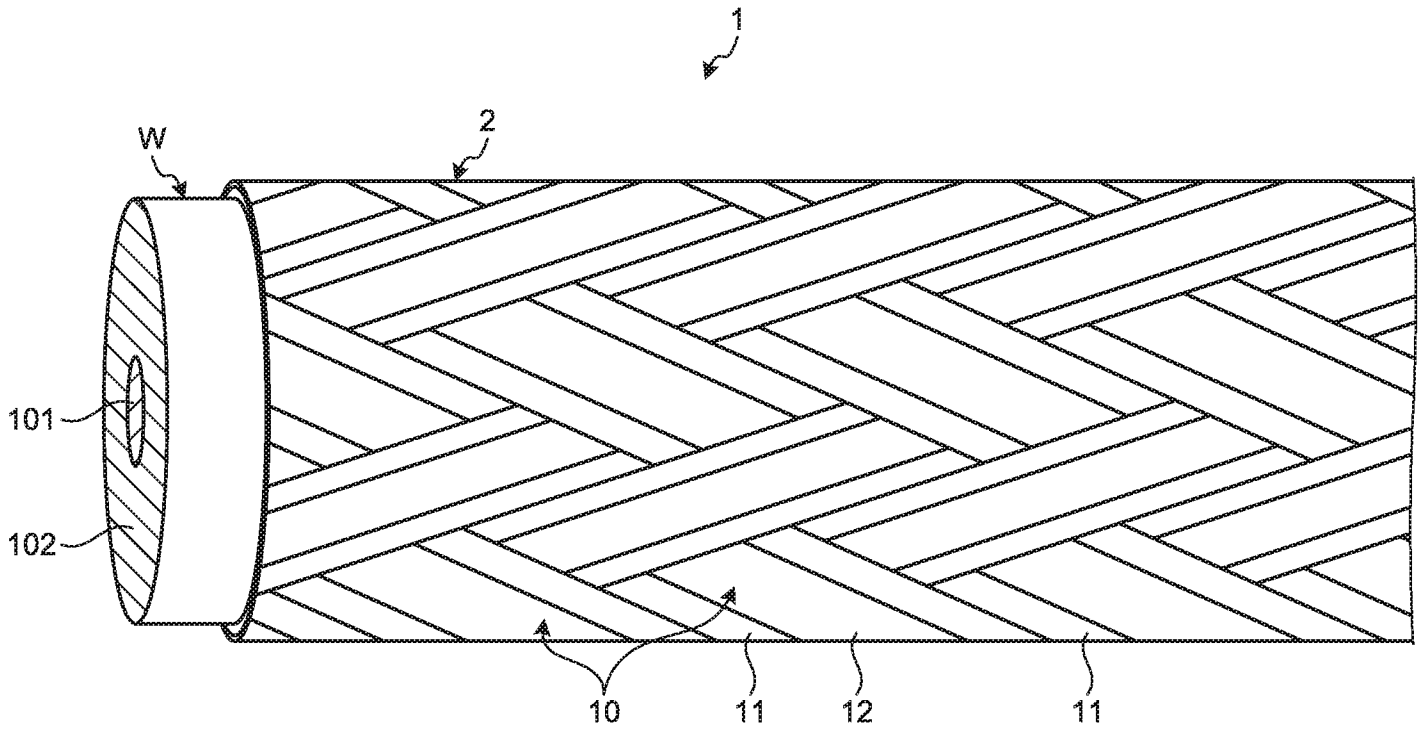
FIG. 1 is a perspective view illustrating an overall configuration of a shielded electrical wire that includes a braided shield according to an embodiment.
Figure 2:
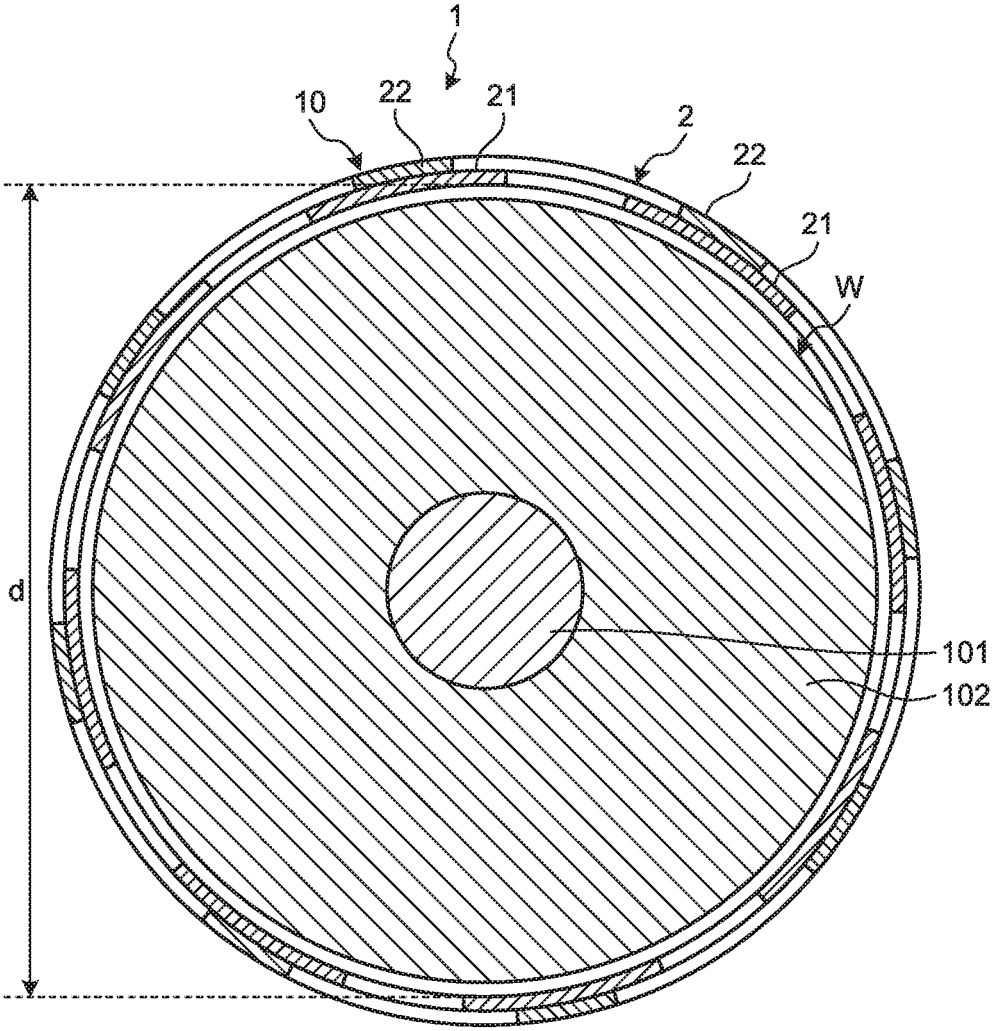
FIG. 2 is a cross-sectional view illustrating the overall configuration of the shielded electrical wire according to the embodiment.

The electrical wire W is provided between a power source (not illustrated) installed in the vehicle, and various electronic devices (not illustrated) that are operated by power from the power source and electrically connects the power source to the various electronic devices, for example. The electrical wire W is preferably flexible. The electrical wire W is configured comprising a core wire 101 and an insulator 102, as illustrated in FIGS. 1 and 2. The core wire 101 is a conductive wire filament made of metal and transmits current supplied from the power source to the various electronic devices. The insulator 102 is formed of an insulating synthetic resin of vinyl chloride or the like and covers the core wire 101 by means of insert molding or the like to prevent exposure of the core wire 101 to the outside.

The braided shield 2 covers an outer circumferential surface of one electrical wire W and is formed by interweaving a plurality of shield members 10 into a cylindrical shape. In the example illustrated in FIGS. 1 and 2, the braided shield 2 covers the outer circumferential surface of one electrical wire W, but is not limited thereto, and may cover the outer circumferential surface of a plurality of bundled electrical wires W. The braided shield 2 is preferably flexible. The braided shield 2 is a so-called electromagnetic shield member for curbing the effect, on the various electronic devices, of electromagnetic noise generated by a high-voltage current flowing in the electrical wire W. The braided shield 2 covers the whole (or a portion) of the electrical wire W along a longitudinal direction, as illustrated in FIG. 1. Therefore, the area of the electrical wire W covered by the braided shield 2 is configured such that the electromagnetic noise that attempts to emanate outside the electrical wire W will be blocked by the braided shield 2. The braided shield 2 has a shield structure obtained by interweaving using a specified number of spindles m, and a number of ends corresponds to one. Here, the number of spindles m signifies the number of wire filament bundles in the braiding. The number of ends signifies the number of wire filaments in one spindle. The braided shield 2 is interwoven such that the gaps between adjacent shield members 10 are small.

Figure 3:
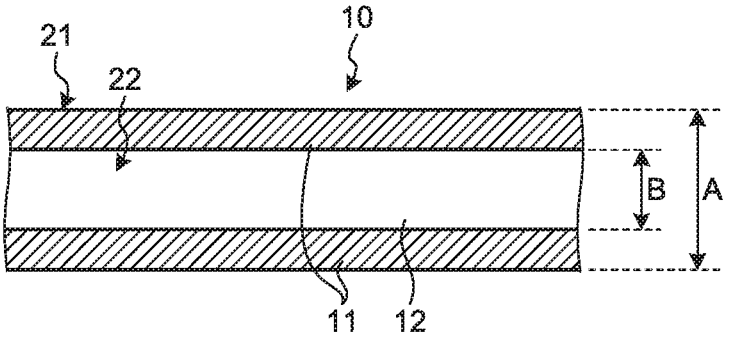
FIG. 3 is a schematic diagram illustrating an overall configuration of a shield member that constitutes the braided shield.

As illustrated in FIG. 3, the shield member 10 has a strip-like non-conductor film 21 and a strip-like conductor member 22.

A non-conductive synthetic resin such as polyethylene, polystyrene, polyvinyl chloride (PVC) or polyimide is used for the non-conductor film 21. The non-conductor film 21 has a thickness on the order of 0.01 to 0.05 mm, for example. The thickness of the non-conductor film 21 is not limited to the foregoing numerical values as long as the thickness is thick in comparison with the diameter of the wire filaments constituting a conventional general braided shield.

In a planar view of the shield member 10, the conductor member 22 is stacked on the non-conductor film 21 along the longitudinal direction thereof such that a non-conductor area 11 and a conductor area 12 are formed separately along a width direction that is orthogonal to the longitudinal direction of the non-conductor film 21. Copper, aluminum, a copper alloy, or an aluminum alloy, or the like, which is conductive, is used, for example, for the conductor member 22. The conductor member 22 has a thickness on the order of 0.05 to 0.5 mm, for example. The thickness of the conductor member 22 is assumed to be slightly thicker than the diameter of the wire filaments constituting a conventional general braided shield. For example, a thin shielded electrical wire (1.5D to 3D) is on the order of 0.05 to 0.5 mm, and a thick shielded electrical wire used for a motor cable or a high voltage cable is on the order of 0.1 to 1.0 mm.

The conductor member 22 forms one conductor area 12 in the center, in the width direction, of the non-conductor film 21, for example (FIG. 3). In the example illustrated in FIG. 3, the conductor area 12 is sandwiched between two non-conductor areas 11 in the width direction.

A width B of the conductor member 22 in a width direction orthogonal to the longitudinal direction of the non-conductor film 21 is shorter than a width A of the non-conductor film 21 in the width direction. That is, the relationship between the width A of the non-conductor film 21 and the width B of the conductor member 22 is A>B. The conductor member 22 is stacked on the non-conductor film 21 of width A, which is greater than the width B of the conductor member 22. If the the number of spindles of the braided shield 2 is m and the inner diameter (diameter) of the braided shield 2 is d (FIG. 2), the width A of the non-conductor film 21 according to the embodiment, that is, the width A of the shield member 10 in the width direction is subject to the relationship of Equation (1) below.

$$A=d\times\pi/m \quad (1)$$

Figure 4:
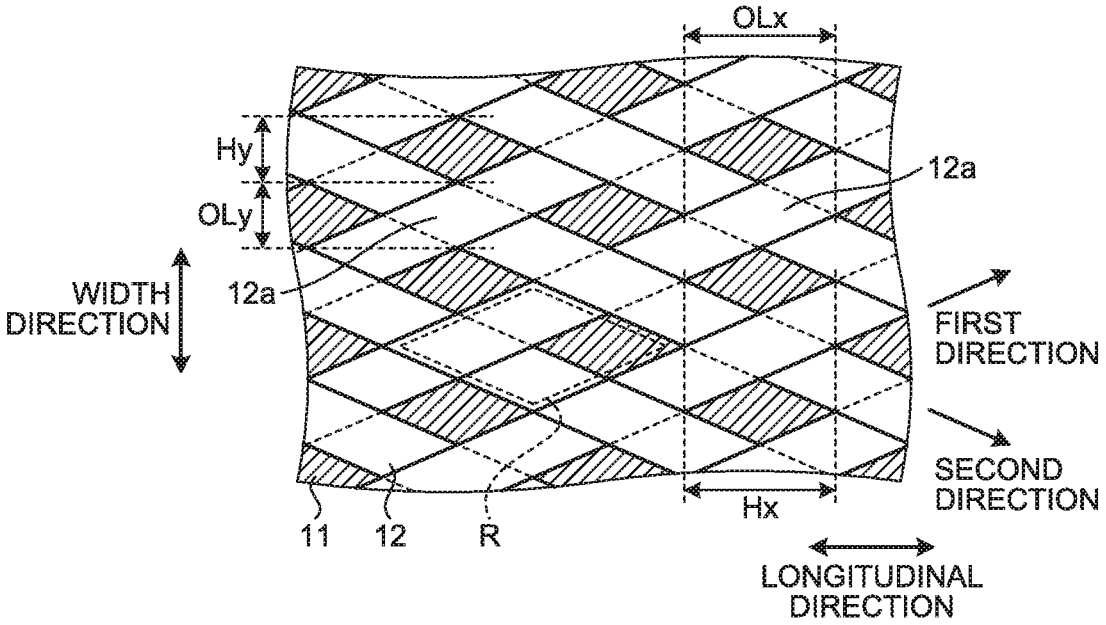
FIG. 4 is a schematic diagram illustrating an overall configuration of the braided shield.

The width B of the conductor member 22 is shorter than the width A of the non-conductor film 21, and the conductor member 22 is subject to the relationship width A:width B=10:5. When a plurality of shield members 10 which are subject to the foregoing relationship are interwoven into a cylindrical shape, an oblique grating-like braided pattern in which the non-conductor area 11 and the conductor area 12 are mixed, as illustrated in FIG. 4, for example, is formed. In the illustrated braided pattern, conductor areas 12 are arranged along a first direction and a second direction that intersects the first direction, respectively. This kind of braided pattern has optimal shield characteristics because the braiding ratio is 75%. When the braiding ratio is 75%, in a braided area R, which includes one of the non-conductor areas 11 and one of a conductor area 12*a* in which a conductor area 12 of a first direction and a conductor area 12 of a second direction overlap each other, the percentage (surface area percentage) of the non-conductor area is 25% of the braided area R. Furthermore, in a braided shield 2 using a shield member 10 in which the width A of the non-conductor film 21 and the width B of the conductor member 22 have a 10:5 ratio relationship, a length Hx of the non-conductor area 11 in a longitudinal direction and a length OLx of the conductor area 12*a* in the longitudinal direction have the same length. Furthermore, in a braided shield 2 using a shield member 10 in which the width A of the non-conductor film 21 and the width B of the conductor member 22 have a 10:5 ratio relationship, a length Hy of the non-conductor area 11 in the width direction and a length OLy of the conductor area 12*a* in the width direction have the same length.

Figure 5:
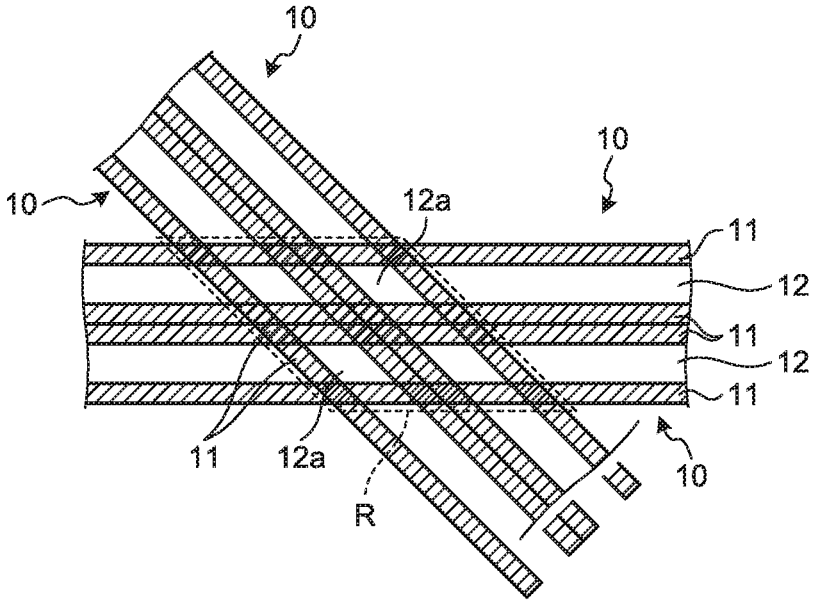
FIG. 5 is a schematic diagram illustrating an overall configuration of a braided area of the braided shield.

In a braided state obtained by interweaving a plurality of the shield members 10 into a cylindrical shape, the plurality of shield members 10 are arranged side-by-side along a first direction and a second direction and form the braided area R in which first two shield members that are a shield member 10 (a first shield member) disposed along the first direction and a shield member 10 adjacent to the first shield member, and second two shield members that are a shield member 10 (a second shield member) disposed along the second direction and a shield member 10 adjacent to the second shield member are overlapped (FIG. 5). In the braided area R, the percentage of the non-conductor area 11 is 25% of the braided area R. That is, for a braided shield 2 using shield members 10 which are subject to a relationship where the ratio of the width A of the non-conductor film 21 to the width B of the conductor member 22 is 10:5, in areas where the shield members 10 intersect each other, the percentage of the conductor area 12 is 25, and the percentage of the non-conductor area 11 is 75%. Thus, the braiding ratio of the braided shield 2 is then 75%.

As described hereinabove, the braided shield 2 according to the embodiment covers the outer circumferential surface of the electrical wire W, and the plurality of shield members 10 are interwoven into a cylindrical shape. The shield members 10 each include a strip-shaped non-conductor film 21 and a strip-shaped conductor member 22 that is shorter than the width of the non-conductor film 21 in the width direction. In a planar view of the shield member 10, the conductor member 22 is stacked on the non-conductor film 21 along the longitudinal direction thereof such that the non-conductor area 11 and the conductor area 12 are formed separately along a width direction of the non-conductor film 21.

Figure 9:
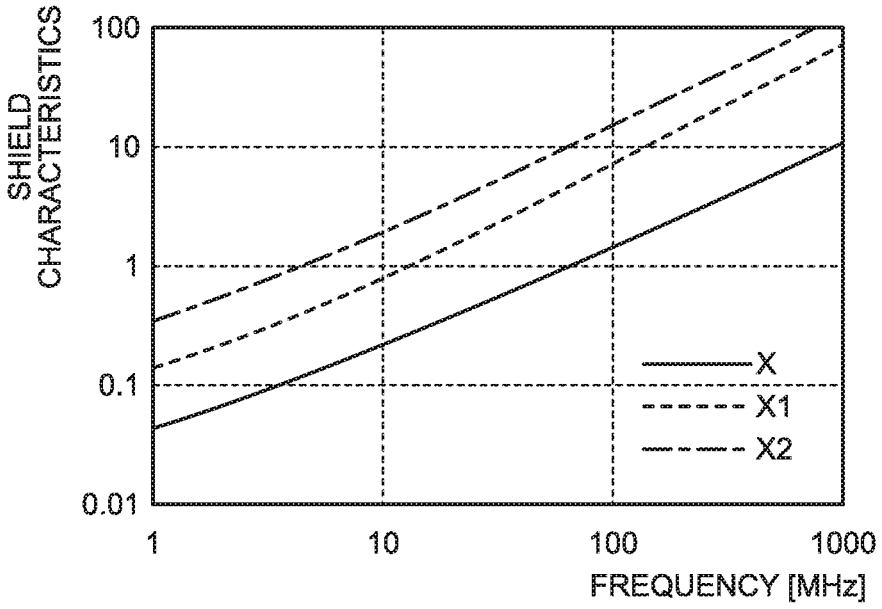
FIG. 9 is a characteristics diagram illustrating an example of the shield characteristics of the shielded electrical wire.
Figure 10:
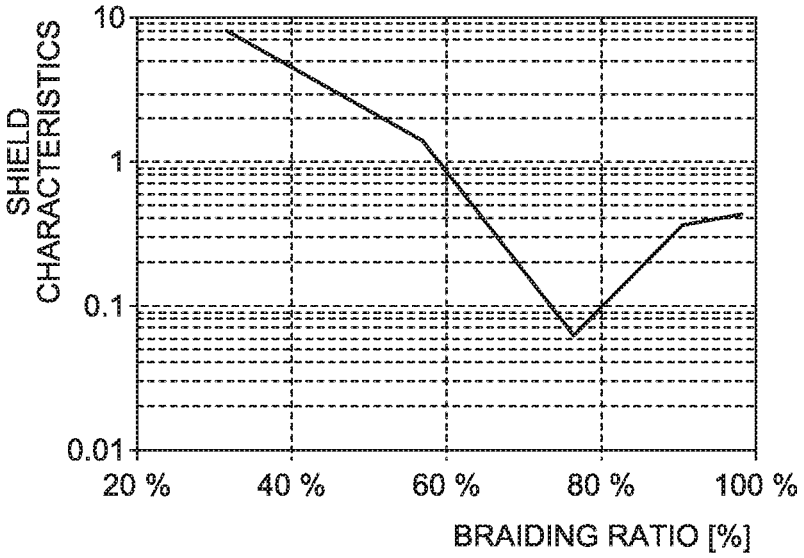
FIG. 10 is a characteristics diagram illustrating the relationship between the shield characteristics and braiding ratio of the shielded electrical wire.

As mentioned earlier, in a conventional shielded electrical wire, when the braiding ratio is raised by increasing the number of wire filaments in the braided shield or reducing the gaps between filament bundles, the shield characteristics also improve, but when the braiding ratio is 100%, the shield characteristics are conversely degraded (FIG. 10). On the other hand, when the braiding ratio is reduced to below 100%, braiding disruption occurs and the shield characteristics are degraded (FIG. 9). According to the foregoing configuration, the braided shield 2 according to the embodiment does not use wire filaments for the braiding, and hence enables suppression of degradation of the shield characteristics caused by wire filament disruption and enables superior shield characteristics to be maintained. In addition, there is then no need to set the braiding ratio high to account for wire filament disruption, and a lightweight construction is enabled by reducing the amount of wire filaments used.

Furthermore, if the width of the non-conductor film 21 is A, the number of spindles of the braided shield 2 is m, and the inner diameter of the braided shield 2 is d, the braided shield 2 according to the embodiment is subject to the foregoing (Equation 1). Thus, by configuring the braided shield 2 according to the relationship of the foregoing (Equation 1), the braiding ratio can be set lower than 100% at 75%, thereby enabling suppression of the conventional degradation of the shield characteristics caused by a rise in the braiding ratio.

In addition, for the braided shield 2 according to the embodiment, if the width of the non-conductor film 21 is A and the width of the conductor member 22 is B, A:B=10:5. Thus, in a braided state obtained by interweaving a plurality of shield members 10 into a cylindrical shape, the braiding ratio can be made lower than 100% to enable suppression of degradation of the shield characteristics caused by the rise in the braiding ratio that accompanies a wire filament increase.

Furthermore, for the braided shield 2 according to the embodiment, in a braided state obtained by interweaving a plurality of the shield members 10 into a cylindrical shape, the plurality of shield members 10 are arranged side-by-side along a first direction and a second direction that intersects the first direction and form a braided area R in which first two shield members that are a shield member 10 (a first shield member) disposed along the first direction and a shield member 10 adjacent to the first shield member, and second two shield members that are a shield member 10 (a second shield member) disposed along the second direction and a shield member 10 adjacent to the second shield member. In the braided area R, the percentage of the non-conductor area 11 is 25% of the braided area R. Thus, the braided shield 2 enables the braiding ratio to be maintained as 75% and enables suppression of degradation of the shield characteristics caused by braiding disruption.

In addition, the shielded electrical wire 1 according to the embodiment comprises the foregoing braided shield 2 and at least one electrical wire W that is inserted into the braided shield 2. Thus, like the braided shield 2, the shielded electrical wire 1 affords the advantageous effects of maintaining the shield characteristics while enabling a lightweight construction by reducing the amount of conductor used in the braiding.

Figure 6:
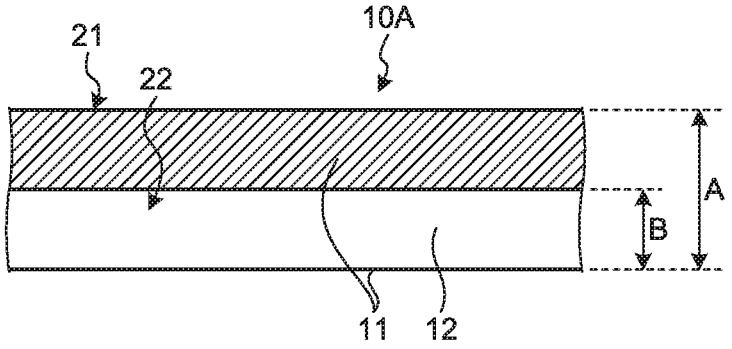
FIG. 6 is a schematic diagram illustrating an overall configuration of a shield member according to a first modification example of the embodiment.

Although the conductor member 22 forms a conductor area 12 in the center, in the width direction, of the non-conductor film 21 in the foregoing embodiment, the present invention is not limited to or by this configuration. FIG. 6 is a schematic diagram illustrating an overall configuration of a shield member according to a first modification example of the embodiment. As illustrated in FIG. 6, in a shield member 10A according to the first modification example, the conductor member 22 forms a conductor area 12 on either of the two edges of the non-conductor film 21 in the width direction.

Figure 7:
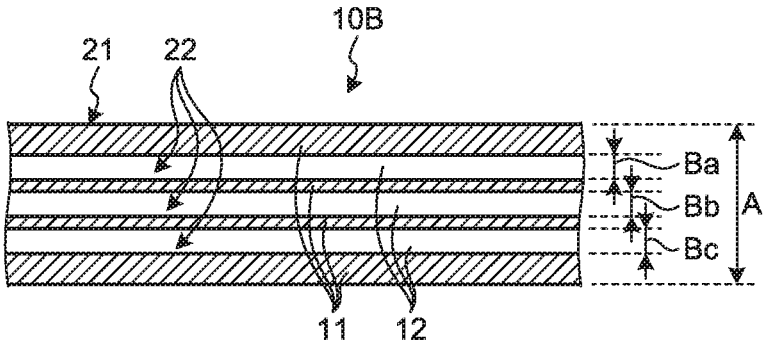
FIG. 7 is a schematic diagram illustrating an overall configuration of a shield member according to a second modification example of the embodiment.
Figure 8:
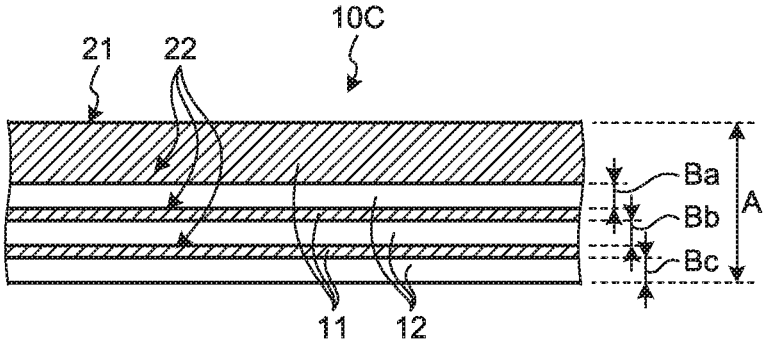
FIG. 8 is a schematic diagram illustrating an overall configuration of a shield member according to a third modification example of the embodiment.

Although the conductor member 22 forms one conductor area 12 in the width direction of the non-conductor film 21 in the foregoing embodiment, the present invention is not limited to or by this configuration. FIG. 7 is a schematic diagram illustrating an overall configuration of a shield member according to a second modification example of the embodiment. FIG. 8 is a schematic diagram illustrating an overall configuration of a shield member according to a third modification example of the embodiment. As illustrated in FIG. 7, in a shield member 10B according to the second modification example, the conductor member 22 forms, in the center along a width direction, a plurality of conductor areas 12 spaced apart along the width direction. The respective conductor areas 12 have three widths Ba, Bb, and Bc along the width direction of the non-conductor film 21, for example. The widths Ba to Bc and width B are subject to the relationship B=Ba+Bb+Bc. The respective widths Ba to Bc may be the same width or may be mutually different widths. As illustrated in FIG. 8, in a shield member 10C according to the third modification example, the conductor member 22 forms a plurality of conductor areas 12 on either of the two edges of the non-conductor film 21 along the width direction and spaced apart along the width direction.

Note that, according to the foregoing embodiment, the width A of the non-conductor film 21 and the width B of the conductor member 22 are subject to the relationship width A:width B=10:5, but the present invention is not limited to or by this relationship. For example, because there may be cases where gaps arise between adjacent shield members 10 and where a plurality of conductor areas 12 are formed along the width direction of the non-conductor film 21 (FIGS. 7 and 8), the relationship width A:width B=10:4 to 10:6 may also be adopted. When width A:width B=10:4 to 10:6, the braiding ratio of the braided shield 2 is then 65% to 85%.

Furthermore, although a case where the electrical wire W in the braided shield 2 is a unifilar core is described in the foregoing embodiment, the core wire may also be a stranded wire obtained by twisting a plurality of wire filaments into a single wire, or the core wire may be at least two or three wires.

Moreover, although a case where the cross-sectional shape of the shielded electrical wire (the braided shield) is circular, as illustrated in FIG. 2, is described in the foregoing embodiment, the present invention is not limited to or by such a cross sectional shape. For example, in a case where a plurality of core wires are arranged side by side along the width direction when viewed from the direction of extension of the shielded electrical wire and where the core wires have a flat structure, the cross-sectional shape of the shielded electrical wire may be elliptical or a polygonal shape such as a rectangle.

The braided shield and shielded electrical wire according to the embodiment afford the advantageous effects of enabling suppression of degradation of the shield characteristics and of enabling a lightweight construction by reducing the amount of conductor used in the braiding.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A braided shield comprising:

at least one electrical wire; and a plurality of shield members that covers an outer circumferential surface of the electrical wire and is formed by interweaving into a cylindrical shape, wherein the shield members each include a strip-shaped non-conductor film, and a strip-shaped conductor member having a width, in a width direction orthogonal to a longitudinal direction of the non-conductor film, that is shorter than a width of the non-conductor film in the width direction, and in a planar view of the shield member, the conductor member is stacked on the non-conductor film along the longitudinal direction thereof such that a non-conductor area and a conductor area are formed separately along the width direction of the non-conductor film.

2. The braided shield according to claim 1, wherein the conductor member forms, spaced apart along the width direction, a plurality of the conductor area.

3. The braided shield according to claim 1, wherein, when the width of the non-conductor film is A, a number of spindles of the braided shield is m, and an inner diameter of the braided shield is d, the following formula is satisfied:

$$A=d\times\pi/m.$$

4. The braided shield according to claim 2, wherein, when the width of the non-conductor film is A, a number of spindles of the braided shield is m, and an inner diameter of the braided shield is d, the following formula is satisfied:

$$A=d\times\pi/m.$$

5. The braided shield according to claim 1, wherein, when the width of the non-conductor film is A and a width of the conductor member is B, the following formula is satisfied:

$$A:B=10:5.$$

6. The braided shield according to claim 2, wherein, when the width of the non-conductor film is A and a width of the conductor member is B, the following formula is satisfied:

$$A:B=10:5.$$

7. The braided shield according to claim 3, wherein, when the width of the non-conductor film is A and a width of the conductor member is B, the following formula is satisfied:

$$A:B=10:5.$$

8. The braided shield according to claim 1, wherein, in a braided state obtained by interweaving the plurality of the shield members into a cylindrical shape, the plurality of the shield members are arranged side-by-side along a first direction and a second direction that intersects the first direction, the plurality of shield members form the braided area in which first two shield members that are a first shield member disposed along the first direction and a shield member adjacent to the first shield member, and second two shield members that are a second shield member disposed along the second direction and a shield member adjacent to the second shield member are overlapped, and in the braided area, the percentage of the non-conductor area is 25% of the braided area.

9. The braided shield according to claim 2, wherein, in a braided state obtained by interweaving the plurality of the shield members into a cylindrical shape, the plurality of the shield members are arranged side-by-side along a first direction and a second direction that intersects the first direction, the plurality of shield members form the braided area in which first two shield members that are a first shield member disposed along the first direction and a shield member adjacent to the first shield member, and second two shield members that are a second shield member disposed along the second direction and a shield member adjacent to the second shield member are overlapped, and in the braided area, the percentage of the non-conductor area is 25% of the braided area.

10. The braided shield according to claim 3, wherein, in a braided state obtained by interweaving the plurality of the shield members into a cylindrical shape, the plurality of the shield members are arranged side-by-side along a first direction and a second direction that intersects the first direction, the plurality of shield members form the braided area in which first two shield members that are a first shield member disposed along the first direction and a shield member adjacent to the first shield member, and second two shield members that are a second shield member disposed along the second direction and a shield member adjacent to the second shield member are overlapped, and in the braided area, the percentage of the non-conductor area is 25% of the braided area.

11. The braided shield according to claim 5, wherein, in a braided state obtained by interweaving the plurality of the shield members into a cylindrical shape, the plurality of the shield members are arranged side-by-side along a first direction and a second direction that intersects the first direction, the plurality of shield members form the braided area in which first two shield members that are a first shield member disposed along the first direction and a shield member adjacent to the first shield member, and second two shield members that are a second shield member disposed along the second direction and a shield member adjacent to the second shield member are overlapped, and in the braided area, the percentage of the non-conductor area is 25% of the braided area.

12. A shielded electrical wire, comprising:

the braided shield according to claim 1; and at least one electrical wire that is inserted into the braided shield.

13. A shielded electrical wire, comprising:

the braided shield according to claim 2; and at least one electrical wire that is inserted into the braided shield.

14. A shielded electrical wire, comprising:

the braided shield according to claim 3; and at least one electrical wire that is inserted into the braided shield.

15. A shielded electrical wire, comprising:

the braided shield according to claim 5; and at least one electrical wire that is inserted into the braided shield.

16. A shielded electrical wire, comprising:

the braided shield according to claim 8; and at least one electrical wire that is inserted into the braided shield.

* * * * *